United States Patent [19]

Sasaki

[11] Patent Number: 4,509,779

[45] Date of Patent: Apr. 9, 1985

[54] LOCKING DEVICE FOR DOOR OF COOKING APPARATUS

[75] Inventor: Takafumi Sasaki, Hokkaido, Japan

[73] Assignee: Tokyo Shibaura Denki Kabushiki Kaisha, Kawasaki, Japan

[21] Appl. No.: 418,835

[22] Filed: Sep. 16, 1982

[30] Foreign Application Priority Data

Sep. 21, 1981 [JP] Japan ..... 56-140043[U]

[51] Int. Cl.[3] ..... E05C 3/32

[52] U.S. Cl. ..... 292/254; 292/DIG. 61; 292/DIG. 69; 292/DIG. 72

[58] Field of Search ..... 292/127, 201, 254, DIG. 61, 292/DIG. 69, DIG. 72

[56] References Cited

U.S. PATENT DOCUMENTS 2,366,847 1/1945 Fendring ..... 292/254

4,341,409 7/1982 Sakoda ..... 292/254

FOREIGN PATENT DOCUMENTS 1130891 10/1956 France ..... 292/DIG. 72

*Primary Examiner*—Richard E. Moore

*Attorney, Agent, or Firm*—Cushman, Darby & Cushman

[57] ABSTRACT

A door locking device for a microwave oven of the present invention has a latch disposed on the rear surface of a door and pivoted clockwise by the urging force of a spring, and an engaging portion which stops a hook at the distal end of the latch. Upon closing operation of the door, the hook engages with the engaging portion to lock the door. For opening the door, a lock release actuator is moved upward to pivot the latch upward to release the locking state of the latch with the engaging portion.

5 Claims, 6 Drawing Figures

LOCKING DEVICE FOR DOOR OF COOKING APPARATUS

BACKGROUND OF THE INVENTION

The present invention relates to a door locking device for opening and closing the door of a cooking apparatus.

A conventional door locking device generally adopts a lock mechanism which has a hook. The door locking device is mounted inside a door, and the hook is operated by a door handle mounted on the door so as to releaseably engage with an engaging hole formed in a cooking (heating) chamber. FIG. 1 shows a door locking device for a microwave oven. Referring to FIG. 1, a movable door handle b is arranged at the front surface of a door a at a free end thereof. A movable hook c is mounted on the rear surface of the door a. The hook c and the door handle b are coupled together by an interlocking mechanism d such as a link incorporated inside the door a. An engaging hole g formed in a locking member f for engaging with the hook c is formed at the front wall of a housing e. Thus, the door handle b may be operated to releasably engage the hook c with the engaging hole g, thereby locking the door a to the housing e and closing a safety switch i. Food in the heating chamber may then be cooked by dielectric heating of microwave energy.

However, in a door locking device adopting the interlocking mechanism d whereby the door handle b is interlocked with the hook c, the structure becomes complex and the number of parts involved increases. Therefore, the overall device becomes costly. Furthermore, since the interlocking mechanism d is arranged inside the door a, extra space is required, imposing a constraint on the degree of freedom in designing of the door a. Opening of the door a requires a two-step operation including unlocking and opening the door, and this is liable to result in inconvenience. Especially, a microwave oven is provided with an electromagnetically sealed door a adopting the high frequency choke system, for example, so that the incorporation of the interlocking mechanism d adversely affects the choke system, and degrades the electromagnetic sealing performance.

SUMMARY OF THE INVENTION

The present invention has been made in consideration of this and has for its object to provide a locking device for a door of a cooking apparatus, which is simple in construction and which is easy to operate.

In order to achieve the above object of the present invention, there is provided a door locking device for a cooking apparatus, comprising:

a first moving member;

a first spring member for elastically supporting the first moving member;

a second moving member having a projection at one end portion thereof;

a second spring member for elastically supporting the second moving member, the urging force of the first spring member being stronger than that of the second spring member;

means for movably supporting therein the first moving member, the first spring member and the second moving member in that order, the supporting means being fixed in a housing of the cooking apparatus and having a window in which the projection of the second moving member is movable;

an engaging member pivotably mounted in the housing to be engaged with the other end portion of the second moving member;

means for pivoting the engaging member within the limit of a predetermined rotation angle about a pivoting axis;

latch means pivotably mounted at the inside of the door;

means for pivoting the latch means within the limit of a predetermined rotation angle about a reference axis;

an engaging portion of the housing for engaging with the latch means and the first moving member;

means for releasing the latch means from being engaged with the engaging portion, the releasing means having door opening operation means and being incorporated with the first and second moving members, the first and second spring members and the pivoting means for engaging member in order for said engaging member to be engaged with the other end portion of second moving member while the releasing means releasing the latch means from being engaged with the engaging portion upon operation of the door opening operation means; and means for switching an energizing circuit of the cooking apparatus in response to the movement of the projection of said second moving member.

DETAILED DESCRIPTION OF THE PREFERRED EMBODIMENT

Figure 1:
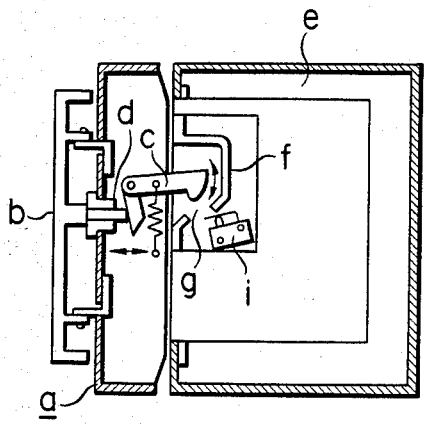
FIG. 1 (PRIOR ART)
FIG. 1 is a longitudinal sectional view showing a conventional door locking device.
Figure 2:
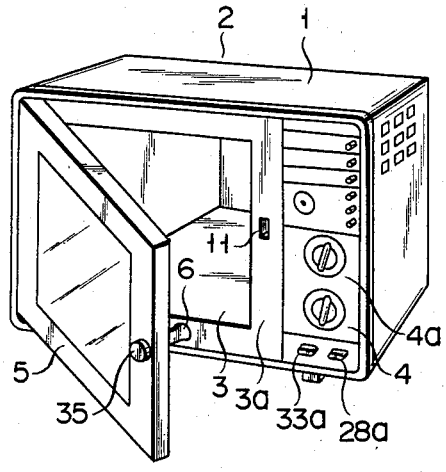
FIG. 2 is a perspective view showing a microwave oven to which the present invention is applied.

An embodiment of the present invention will now be described with reference to the accompanying drawings. Referring to FIG. 2, a cooking (heating) chamber 3 is arranged inside a housing 1 of a microwave oven 2. Heating equipment such as a high-frequency oscillator (not shown) and a heater (not shown) is arranged inside the housing 1. Food (not shown) in the heating chamber 3 is cooked by heating energy of the heating equipment. A control panel 4 having various operation sections **4*a* such as a plurality of cooking selection controls, a cooking timer and a cooking start switch, is arranged at the right-hand side of the front surface of the housing 1. The desired cooking may be performed by operating the operation sections 4*a*. A transversely opening door 5 is pivotally supported at the left-hand side of the front surface of the housing 1, to lie to the left of the operation panel 4. The door 5 opens/closes the opening of the heating chamber 3. A door locking device 6 is arranged at the free end of the rear surface of the door 5 and at the corresponding front wall 3*a* of the heating chamber 3**.

Figure 3:
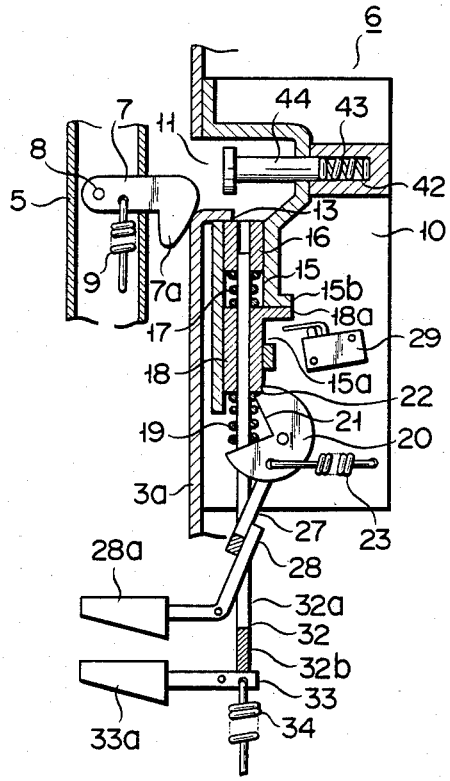
FIG. 3 is a longitudinal-sectional view showing a door locking device according to an embodiment of the present invention.

FIG. 3 shows the detail of the structure of the door locking device 6. Reference numeral 7 denotes a latch having a substantially triangular hook **7*a*. The proximal end portion of the latch 7 is pivotal about a shaft 8** disposed on the rear surface of the free end of the door 5. The latch 7 is urged clockwise by a spring 9 and is supported by another stopper (not shown) to be kept horizontal. When an external force is applied to the latch 7, it is rotated counterclockwise against the urging force of the spring 9. Reference numeral 10 denotes a lock base body which is disposed behind the front surface wall 3*a* of the heating chamber 3 and which corresponds to the latch 7. Reference numeral 11 denotes a receiving recess for the latch 7 which is formed in the front wall 3*a*. An engaging portion 13 for the latch 7 is formed at the lower edge of the receiving recess 11 by bending the front surface wall 3*a* back inside. A hollow guide 15 is formed on the lock base body 10 and extends downward from the receiving recess 11. A first cylindrical moving body 16, a first spring 17 and a second cylindrical moving body 18 are vertically and movably mounted inside the hollow guide 15. A projection 18*a* transversely extends from the upper end portion of the second cylindrical moving body 18. A guide window 15*a* is formed on the side surface of the hollow guide 15 to guide the projection 18*a*. Reference numeral 19 denotes a second spring the lower end of which is supported on part of the lock base body 10 to support the second cylindrical moving body 18. The second cylindrical moving body 18 is supported by the second spring 19, and the upper end face of the second cylindrical moving body 18 abuts against a stopper 15*b* of the hollow guide 15. Thus, the second cylindrical moving body 18 is positioned. The first cylindrical moving body 16 and the first spring 17 whose urging force is stronger than the second spring 19 are housed between the second cylindrical moving body 18 and the engaging portion 13. Reference numeral 20 denotes a disk-shaped cam as an engaging member which has a sector-shaped notch 21. A step-shaped stopper 22 is disposed at the distal end of the cam corresponding to one side wall of the notch 21. The cam 20 is urged counterclockwise by a spring 23 to engage the stopper 22 with the lower end of the second cylindrical moving body 18, thereby defining the range of downward movement of the second cylindrical moving body 18. An L-shaped arm 27 extends from the cam 20. Reference numeral 28 denotes a control lever which is pivotally mounted at the lower side of the control panel 4 (FIG. 2) to pivot the cam 20. A cooking start button 28*a* is mounted on the distal end portion of the control lever 28. The cam 20 is pivoted clockwise by means of the control lever 28 via the arm 27, so that locking of the second cylindrical moving body 18 by the stopper 22 can be released. Reference numeral 29 denotes a safety switch disposed on the track of the projection 18*a* of the second cylindrical moving body 18. The safety switch 29 is connected to a power supply circuit (not shown) of the microwave oven and functions as the main switch for specifying the start of cooking. A lock release actuator 32 has an insertion member 32*a* and a transmitting member 32*b*, and has an L-shaped structure as a whole. The insertion member 32*a* of the lock release actuator 32 is inserted into the first cylindrical moving body 16, the first spring 17, the second cylindrical moving body 18 and the second spring 19 to be reciprocated therealong, such that the distal end portion of the insertion member 32*a* is not always flush with the distal end portion of the first cylindrical moving body 16. The proximal end portion of the transmitting member 32*b* is stopped by a lock release lever 33. The lock release lever 33 is pivotally mounted on the control panel 4 and is adjacent to the control lever 28. A door opening button 33*a* is mounted on the distal end portion of the lock release lever 33. When the operator pushes downwardly the door opening button 33*a*, this pivots the lock release lever 33. The lock release actuator 32 is then moved upward, and the distal end of the insertion member 32*a* urges the hook 7*a* of the latch 7 upward, thereby pivoting the latch 7 upward and releasing the engagement of the latch 7 with the engaging portion 13. Reference numeral 34 denotes a spring for causing the lock release actuator 32 to return to its initial position. Reference numeral 42 denotes a cylinder disposed in the lock base body 10 so as to oppose the latch 7. A door opening pusher 44 which is urged by a spring 43 toward the receiving recess 11 is free to reciprocate in the cylinder 42. Reference numeral 35 denotes a knob disposed on the front side of the door 5.

Figure 4C:
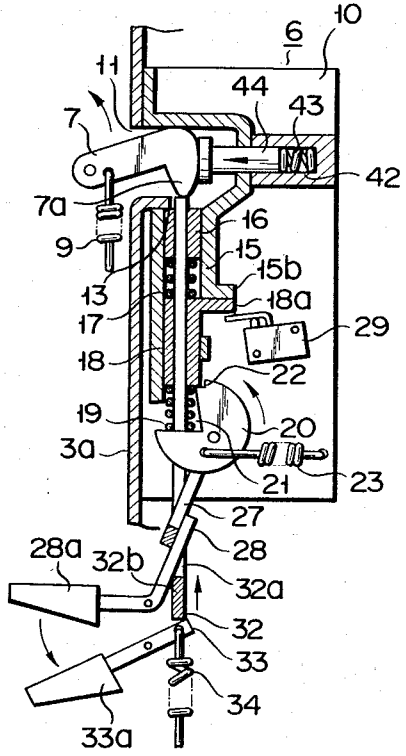
FIGS. 4A to 4C are views for explaining respectively a door locking state, a control operation in the door locking mode, and a door lock release operation.
Figure 4B:
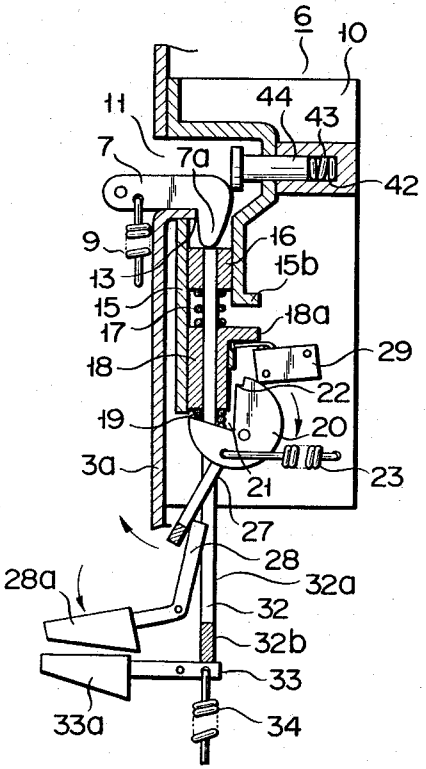
Figure 4A:
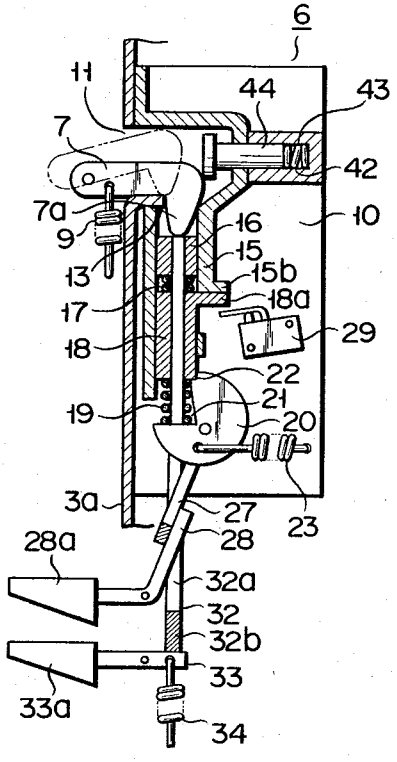

When the operator wishes to close the door 5 of the microwave oven 2, he or she pushes the knob 35 to pivot the door 5 toward the closed position. Upon this operation, the outer tilt surface of the hook 7*a* of the latch 7 slides along the curved surface of the engaging portion 13 of the housing 1, and the latch 7 is pivoted upward against the urging force of the spring 9 and is inserted into the side of the housing 1. Furthermore, as the door opening pusher 44 is urged by the latch 7, the first cylindrical moving body 16 is simultaneously urged against the lower end of the hook 7*a* by the first spring 17 by means of the restoring force of the spring 9. Thus, the latch 7 engages with the front surface wall 3*a* of the heating chamber 3. As shown in FIG. 4A, the door 5 is locked.

Thereafter, when the operator presses the cooking start button 28*a*, the control lever 28 via the arm 27 causes the cam 20 to pivot clockwise. Upon pivotal movement of the cam 20, the second cylindrical moving body 18 which is held by the stopper 22 of the cam 20 is released. The restoring force of the first spring 17 causes the second spring 19 to move the second cylindrical moving body 18 downward. In this case, the safety switch 29 is turned on by the projection 18*a* of the second cylindrical moving body 18, as shown in FIG. 4B, and cooking is thereby started.

When the operator wishes to open the door 5 after cooking is finished, he or she presses the door opening button 33*a* to pivot the lock release lever 33 so as to move the lock release actuator 32 upward. Upon movement of the lock release actuator 32, the distal end of the insertion member 32*a* pops up from the upper end surface of the first cylindrical moving body 16. The hook 7*a* of the latch 7 is then pushed upward, so that locking is released. The latch 7 is then urged to open the door 5 by the door opening pusher 44, as shown in FIG. 4C. Thus, the door 5 is opened. Upon the release of the latch 7, the first and second cylindrical moving bodies 16 and 18 are returned to their initial state by the restoring force of the second spring 19. At the same time, the safety switch 29 is turned off. The cam 20 is pivoted counterclockwise by the restoring force of the spring 23 to engage the stopper 22 with the lower end of the second cylindrical moving body 18. Thus, movement of the second cylindrical moving body 18 is regulated. Simultaneously, the cooking start button 28*a* returns to the initial position. Meanwhile, the lock release lever 33 is pivoted clockwise by the spring 34 to move the lock release actuator 32 downward, and the door opening button 33*a* returns to the initial position.

Since the door locking device according to the present invention does not have a conventional complex interlocking mechanism inside the door 5, the door 5 can be simply assembled, decreasing the manufacturing cost. Even in an electromagnetically sealed door adopting a high frequency choke system, its structure is not adversely affected, thereby providing excellent electromagnetic sealing effect. Furthermore, since the conventional interlocking mechanism as described above is not incorporated inside the door 5, there may be less limitation with respect to the design of the door. The lock release actuator 32 may be inserted in the first and second cylindrical moving bodies 16 and 18 on the side of the housing 1 to obtain an integral body. Many components need not be housed in the housing 1, thus providing a compact structure.

When the operator wishes to close the door 5, he or she holds the knob 35 mounted on the front surface of the door 5 and pivots it in the closing direction to lock the door 5. The opening/closing operation of the door 5 is simpler than that of the conventional device in which a control handle is operated. On the other hand, when the operator wishes to open the door 5, he or she simply presses the door opening control button 33*a* to release the latch 7, and at the same time the door 5 is opened by the door opening pusher 44. Thus, the opening and closing of the door 5 is very much simplified.

Furthermore, unless the door 5 is locked and the first spring 17 is urged by the stopper 7 via the first cylindrical moving body 16, the second cylindrical moving body 18 can not be moved downward since it is urged by the second spring 19, even if the operator presses the cooking start button 28*a* to release the second cylindrical moving body 18. Thus, the safety switch may not be turned on. In a microwave oven in which food is heated by microwave generated by a magnetron, the microwave energy can not be generated before the door 5 is completely locked. The high frequency waves can not leak outside the microwave oven, thus guaranteeing safety.

In the above embodiment, although the above embodiment is applied to a transversely opening door, it may also be applied to a vertically opening door. Furthermore, in the above embodiment, the present invention is applied to a microwave oven. However, the present invention may also be applied to cookers which have a heating function by means of an electric heater, a gas heater, or the like.

In summary, according to the door locking device of the present invention, a single pulling or pushing operation can effect opening/closing of the door, thus simplifying operation of the cookers. Furthermore, since the movable door handle and the conventional interlocking mechanism are not used at all and the components are aligned in the housing, the overall arrangement of the device is very much simplified thus providing a simple and compact structure and a highly accurate operation.

What is claimed is:

1. A locking device for a door of a cooking apparatus, comprising:

a first moving member;

a first spring member operatively connected to said first moving member for elastically supporting said first moving member;

a second moving member having a projection at one end portion thereof;

a second spring member operatively connected to said second moving member for elastically supporting said second moving member, and wherein the urging force of said first spring member is greater than that of said second spring member;

means for movably supporting therein said first moving member, said first spring member and said second moving member in that order, said supporting means being fixed in a housing of the cooking apparatus and having a window in which said projection of said second moving member is movable;

an engaging member pivotally mounted in the housing to be engaged with the other end portion of said second moving member;

means for pivoting said engaging member within the limit of a predetermined rotation angle about a pivoting axis;

latch means pivotable mounted to an inside portion of the door;

means for pivoting said latch means within the limit of a predetermined rotation angle about a reference axis;

an engaging portion of the housing for engaging with said latch means and said first moving member;

means for releasing said latch means from being engaged with said engaging portion, said releasing means having door opening operation means and being incorporated with said first and second moving members, said first and second spring members and said pivoting means for moving said engaging member in order for said engaging member to be engaged with the other end portion of said second moving member while said releasing means releases said latch means from being engaged with said engaging portion upon operation of said door opening operation means; and means for switching an energizing circuit of the cooking apparatus in response to the movement of said projection of said second moving member.

2. A device according to claim 1, wherein said first and second moving members respectively comprise hollow bodies through which a release actuator of said releasing means extends.

3. A device according to claim 1 or 2, wherein said engaging member is of disc-shape cam, a sector-shaped notched portion is formed around a circumference of said cam and a step-shaped stopper, which is engaged with the other end portion of said second moving member, is disposed at the distal end of the one side wall of the notch.

4. A device according to claim 3, wherein said releasing means further comprises a door opening pusher, which is urged by a spring in a direction toward said latch and which is disposed at a side of said housing to oppose said latch.

5. A device according to claim 1 or 2 wherein said releasing means further comprises a door opening pusher, which is urged by a spring in a direction toward said latch and which is disposed at a side of said housing to oppose said latch.

* * * * *